US010808644B2

(12) United States Patent
Byun et al.

(10) Patent No.: US 10,808,644 B2
(45) Date of Patent: Oct. 20, 2020

(54) METHOD AND APPARATUS FOR PREVENTING ENGINE STALL OF VEHICLE

(71) Applicants: HYUNDAI MOTOR COMPANY, Seoul (KR); KIA MOTORS CORPORATION, Seoul (KR)

(72) Inventors: Jung-Sup Byun, Seongnam-si (KR); Bon-Chang Koo, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 63 days.

(21) Appl. No.: 16/205,131

(22) Filed: Nov. 29, 2018

(65) Prior Publication Data

US 2019/0293018 A1 Sep. 26, 2019

(30) Foreign Application Priority Data

Mar. 22, 2018 (KR) ..... 10-2018-0033292

(51) Int. Cl.
*F02D 41/38* (2006.01)

(52) U.S. Cl.
CPC ..... *F02D 41/38* (2013.01); *F02D 2200/0602* (2013.01); *F02D 2200/101* (2013.01)

(58) Field of Classification Search
CPC ..... F02D 41/38; F02D 2200/101; F02D 2200/0602; F02D 41/08; F02D 41/3854; F02D 41/3082; F02D 2041/224; F02D 41/16; F02D 41/3836
See application file for complete search history.

(56) References Cited

U.S. PATENT DOCUMENTS

2003/0010319 A1* 1/2003 Ishimoto ..... F02M 55/00 123/446
2011/0098976 A1* 4/2011 Hofmeister ..... F02D 41/062 702/183
2013/0218441 A1* 8/2013 Thomas ..... F02D 41/065 701/105
2014/0109876 A1* 4/2014 Dolker ..... F02D 41/3863 123/479
2017/0107931 A1* 4/2017 Anetsberger ..... F02M 59/022

FOREIGN PATENT DOCUMENTS

KR 10-2013-0045991 A 5/2013

* cited by examiner

*Primary Examiner* — Joseph J Dallo
(74) *Attorney, Agent, or Firm* — Morgan, Lewis & Bockius LLP

(57) ABSTRACT

A method of preventing an engine stall of a vehicle having a fuel injection device for pressurizing fuel stored in a fuel tank by a high-pressure fuel pump to transmit the fuel to a common rail, and injecting the fuel temporarily stored in the common rail into an engine through an injector may include steps of determining whether or not a drift occurs in an output signal of a high-pressure fuel pressure sensor for measuring fuel pressure at a downstream side of the high-pressure fuel pump, and performing a fuel pressure control by replacing a high-pressure fuel pressure value with a predetermined pressure value based on the output signal of the high-pressure fuel pressure sensor.

16 Claims, 7 Drawing Sheets

-RELATED ART-

METHOD AND APPARATUS FOR PREVENTING ENGINE STALL OF VEHICLE

CROSS-REFERENCE TO RELATED APPLICATIONS

This application claims the benefit of priority to Korean Patent Application No. 10-2018-0033292 filed on Mar. 22, 2018 with the Korean Intellectual Property Office, which is incorporated herein by reference in its entirety.

TECHNICAL FIELD

The present disclosure relates to a method and an apparatus for preventing an engine stall of a vehicle, and more particularly, to a method and an apparatus, which can prevent an engine stall of a vehicle when a drift has occurred in an output signal of a high-pressure fuel pressure sensor.

BACKGROUND

A fuel supply system of an engine, particularly, a fuel supply system of a Gasoline Direct Injection (GDI) engine can be classified into a high-pressure system and a low-pressure system. Like a fuel injection device 2 illustrated in FIG. 1, the high-pressure system can include a high-pressure pump 2*a* for again compressing the fuel pumped from a fuel tank with high pressure by a low-pressure fuel pump, a fuel filter 2*b* for filtering the fuel pumped by the high-pressure pump 2*a*, a common rail 2*c* for maintaining the pressure of the high-pressure fuel filtered by the fuel filter 2*b* as it is, and distributing it into an individual injector 2*e* through a high-pressure fuel pipe 2*d*, an injector 2*e* for injecting the fuel supplied through the high-pressure fuel pipe 2*d* into a combustion chamber of an engine 6, a high-pressure fuel pressure sensor (not illustrated), etc. On the other hand, the low-pressure system can include a low-pressure pump, a low-pressure fuel pressure sensor, etc. which can transmit the fuel stored in the fuel tank to the high-pressure system.

Meanwhile, the amount of fuel supplied into the cylinder of the engine is determined by the pressure value of the high-pressure fuel in the common rail 2*c* and the electric pulse time applied to the injector 2*e*. Accordingly, an engine control unit 1 first determines a required injection fuel amount and a target high-pressure fuel pressure corresponding to the injection fuel amount in order to obtain a target output torque. Then, the engine control unit 1 measures the fuel pressure at the downstream side of the high-pressure pump 2*a* using a high-pressure fuel pressure sensor, determines a control duty value of a motor actuator of the high-pressure pump 2*a* using the measured fuel pressure and the target fuel pressure, and feed-controls a motor 41 depending upon the determined control duty value.

Accordingly, it is important to accurately measure the actual high-pressure fuel pressure value in order to supply an accurate injection fuel amount to the engine. When the measured pressure value is excessively higher or lower than the actual fuel pressure, the fuel injection amount is also calculated inaccurately and appropriate fuel is not supplied. As a result, a problem of an engine stall can occur.

Meanwhile, an unstable change in sensitivity or an output level due to time, temperature, or any cause is referred to as instability of the sensor characteristic or a drift. When the drift occurs in an output signal of the high-pressure fuel pressure sensor for measuring the high-pressure fuel pressure, as illustrated in FIG. 5A, the measured fuel pressure instantaneously increases or decreases.

Accordingly, when the fuel amount control is performed using the sensor signal in which the drift has occurred, the fuel amount is miscalculated based on the erroneous fuel pressure. That is, there occurs a problem in that the fuel is instantaneously, excessively injected leanly or richly and thereby, as illustrated in FIG. 5A, the RPM of the engine becomes unstable, thus causing engine stall phenomenon.

The contents described in the background are to help the understanding of the background of the present disclosure, and can include what is not previously known to those skilled in the art to which the present disclosure pertains.

SUMMARY

The present disclosure is intended to solve the problem of the related art described above, and an object of the present disclosure is to provide a method of preventing an engine stall of a vehicle and an apparatus for preventing the engine stall of a vehicle, which can solve the problem of engine stall caused when a drift has occurred in an output signal of a high-pressure fuel pressure sensor.

The present disclosure compares the target pressure with the high-pressure fuel pressure measured through the high-pressure fuel pressure sensor to determine whether or not a signal drift occurs. In addition, when it is determined that the drift has occurred in the output signal, the present disclosure performs a pressure control by not using the output value of the high-pressure fuel pressure sensor and using a predetermined pressure value or a low-pressure fuel pressure at the upstream of the high-pressure fuel pump, thus suppressing engine stall due to the signal drift.

More specifically, the present disclosure for solving the above problem relates to a method of preventing an engine stall of a vehicle having a fuel injection device for pressurizing the fuel stored in a fuel tank by a high-pressure fuel pump to transmit the fuel to a common rail, and injecting the fuel temporarily stored in the common rail into an engine through an injector. The method may include steps of determining whether or not a drift occurs in an output signal of a high-pressure fuel pressure sensor for measuring fuel pressure at a downstream side of the high-pressure fuel pump; and performing a fuel pressure control by replacing a high-pressure fuel pressure value with a predetermined pressure value based on the output signal of the high-pressure fuel pressure sensor.

A method of preventing an engine stall of a vehicle in accordance with another preferred embodiment of the present disclosure for solving the above problem may include steps of performing a fuel pressure control by not using an output signal of a high-pressure fuel pressure sensor and performing a low-pressure control based on low-pressure fuel pressure at an upstream side of the high-pressure fuel pump when it is determined that a drift has occurred in the output signal of the high-pressure fuel pressure sensor for measuring fuel pressure at a downstream side of the high-pressure fuel pump.

More preferably, the method of preventing the engine stall of the vehicle may include performing the fuel pressure control by replacing the high-pressure fuel pressure value with the predetermined pressure value based on the output signal of the high-pressure fuel pressure sensor, and then performing the fuel pressure control through a low-pressure control based on low-pressure fuel pressure at the upstream side of the high-pressure fuel pump.

More preferably, the method of preventing the engine stall of the vehicle may further include determining whether or not a vehicle is now in an idle driving state, and when the vehicle is in the idle driving state, the fuel pressure control is performed.

More preferably, the predetermined pressure value is determined from a predetermined map relating to the fuel pressure value depending upon the driving state of the vehicle.

More preferably, the step of determining the whether or not the drift occurs in the output signal of the high-pressure fuel pressure sensor may include determining whether or not a pressure difference between a target fuel pressure and an actual fuel pressure measured from the high-pressure fuel pressure sensor is equal to or greater than a certain value; increasing a counter when the pressure difference is equal to or greater than the certain value; and determining that the drift has occurred in the output signal of the high-pressure fuel pressure sensor when the counter is equal to or greater than a certain value.

More preferably, the method of preventing the engine stall of the vehicle may further include determining whether or not a predetermined time has elapsed after a start-up, and performing the fuel pressure control when it is determined that the predetermined time has passed after the start-up.

An apparatus for preventing an engine stall in accordance with the present disclosure for solving the above problem may include a fuel injection device for pressurizing fuel stored in a fuel tank by a high-pressure fuel pump to transmit the fuel to a common rail, and injecting the fuel temporarily stored in the common rail into an engine through an injector; a high-pressure fuel pressure sensor for measuring high-pressure fuel pressure at a downstream side of the high-pressure fuel pump; and a engine control unit for determining whether or not a drift occurs in an output signal of a high-pressure fuel pressure sensor, and upon occurrence of the drift, performing a fuel pressure control by replacing a high-pressure fuel pressure value with a predetermined pressure value based on the output signal of the high-pressure fuel pressure sensor.

An apparatus for preventing an engine stall in accordance with another preferred embodiment of the present disclosure for solving the above problem may include a fuel injection device for pressurizing fuel stored in a fuel tank by a high-pressure fuel pump to transmit the fuel to a common rail, and injecting the fuel temporarily stored in the common rail into an engine through an injector; a high-pressure fuel pressure sensor for measuring high-pressure fuel pressure at a downstream side of the high-pressure fuel pump; and an engine control unit for determining whether or not a drift occurs in an output signal of a high-pressure fuel pressure sensor, and upon occurrence of the drift, performing a fuel pressure control by not using the output signal of the high-pressure fuel pressure sensor and performing a low-pressure control based on low-pressure fuel pressure at an upstream side of the high-pressure fuel pump.

Preferably, the engine control unit performs the fuel pressure control by replacing the high-pressure fuel pressure value based on the output signal of the high-pressure fuel pressure sensor with the predetermined pressure value, and then performs the fuel pressure control through a low-pressure control based on low-pressure fuel pressure at the upstream side of the high-pressure fuel pump.

Preferably, the engine control unit performs the fuel pressure control when the vehicle is in an idle driving state.

Preferably, the engine control unit includes a predetermined map relating to the fuel pressure value depending upon a driving state of the vehicle, and the predetermined pressure value is determined using the predetermined map.

According to an aspect of the present disclosure, an engine control unit can perform a pressure control by not using an output value of a high-pressure fuel pressure sensor and using a predetermined pressure value or a low-pressure fuel pressure at an upstream of a high-pressure fuel pump when a drift has occurred in the output signal of the high-pressure fuel pressure sensor. Thus, an engine stall due to a signal drift can be effectively suppressed and the vehicle stability can be secured.

DETAILED DESCRIPTION

Hereinafter, embodiments of the present disclosure will be described in detail with reference to the accompanying drawings.

Figure 1:
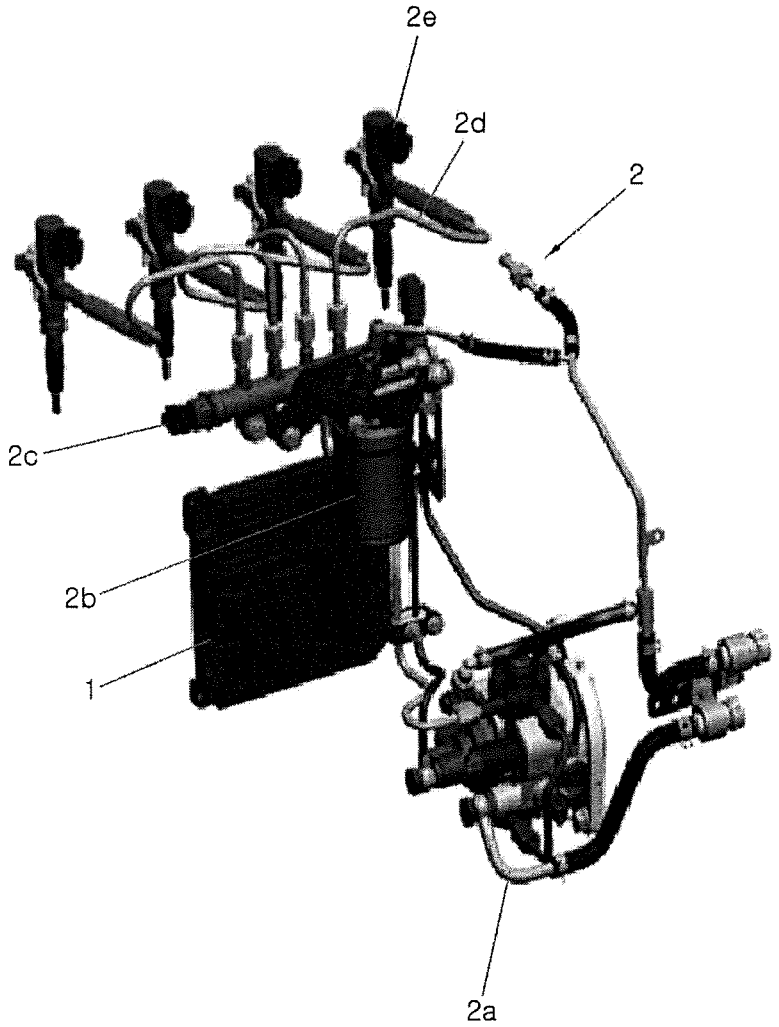
FIG. 1 is a diagram illustrating a configuration of a high-pressure system of a fuel supply system of a GDI engine.
Figure 2:
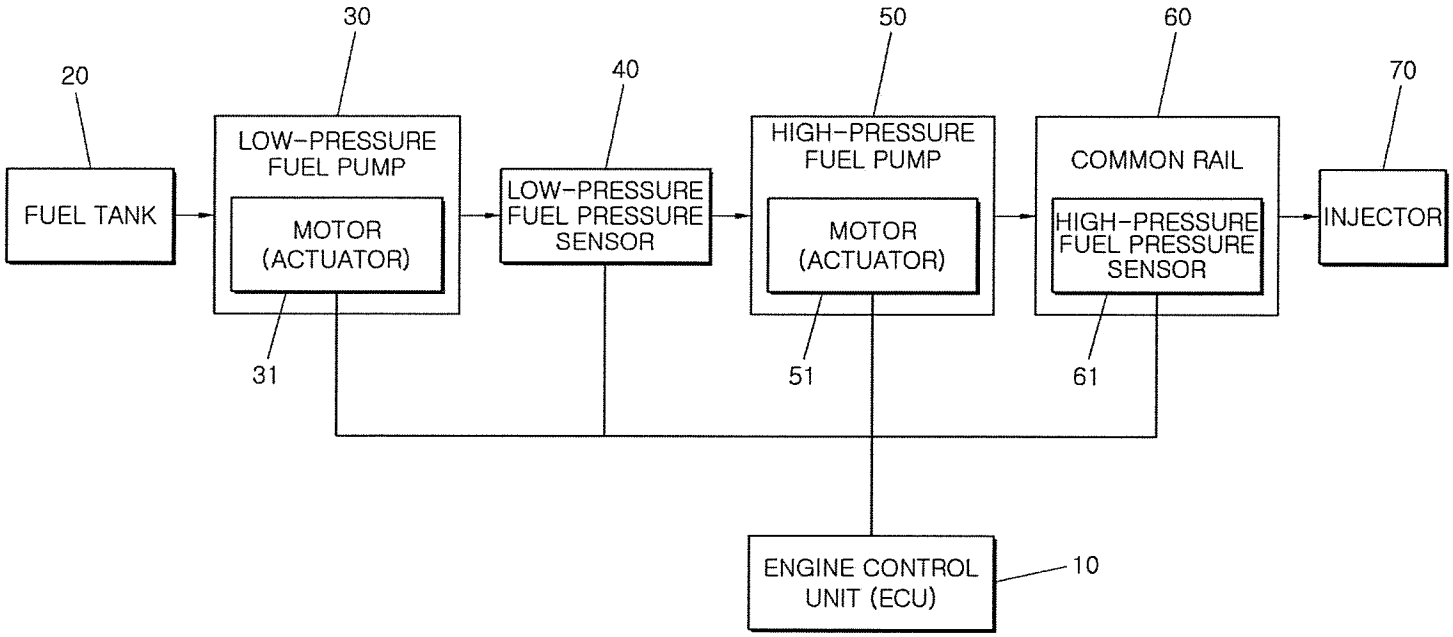
FIG. 2 is a block diagram illustrating a configuration of an apparatus for preventing engine stall in accordance with a preferred embodiment of the present disclosure.

FIG. 2 is a block diagram illustrating a configuration of an apparatus for preventing engine stall in accordance with a preferred embodiment of the present disclosure.

An apparatus for preventing engine stall in accordance with the present disclosure is configured to include a fuel injection device including a high-pressure fuel pump 50, a common rail 60, and an injector 70; an engine control unit 10 for controlling the fuel injection device to prevent engine stall; a high-pressure fuel pressure sensor 61 for measuring high-pressure fuel pressure at the downstream of the high-pressure fuel pump 50, and/or a low-pressure fuel pressure sensor 40 for measuring low-pressure fuel pressure at the upstream of the high-pressure fuel pump 50.

First, referring to FIG. 2, a fuel supply system of an engine to which the apparatus for preventing engine stall in accordance with the present disclosure can be applied will be described.

The designated fuel is stored in a fuel tank 20, and the fuel stored in the fuel tank 20 is pumped at a predetermined low pressure by a low-pressure fuel pump 30 to be supplied to the high-pressure system including the high-pressure fuel pump. The engine control unit 1 determines a control duty value of a motor actuator (BLDC motor) 31 using a target low-pressure pressure value and the fuel pressure value at the downstream of a low-pressure fuel pump 30 measured from the low-pressure fuel pressure sensor 40, and feedback-controls the motor actuator depending upon the control duty value to control so that the fuel discharged from the low-pressure fuel pump 30 can achieve a predetermined low pressure.

The low-pressure fuel discharged from the low-pressure fuel pump 30 is compressed to a higher pressure by the high-pressure fuel pump 50. The compressed high-pressure fuel is temporarily stored in the common rail 60, and supplied to the injector 70 of a plurality of cylinders through a high-pressure fuel pipe (not illustrated) to be injected into the plurality of cylinders of the engine.

The supply amount of the fuel supplied into the cylinder is, as described above, determined depending upon the pressure value of the high-pressure fuel and the electric pulse time of the signal for controlling the injector. Accordingly, in order to obtain a target output torque, the engine control unit 10 determines the required injection fuel amount and the target high-pressure fuel pressure corresponding to the required injection fuel amount. Then, the engine control unit 10 measures the fuel pressure at the downstream side of the high-pressure fuel pump 50 using the high-pressure fuel pressure sensor 61, and then determines a control duty value of a motor actuator 51 of the high-pressure fuel pump 50 so that the measured high-pressure fuel pressure follows the target pressure, and feedback-controls the motor actuator 51 of the high-pressure fuel pump 50 depending upon the determined control duty value.

Figure 3:
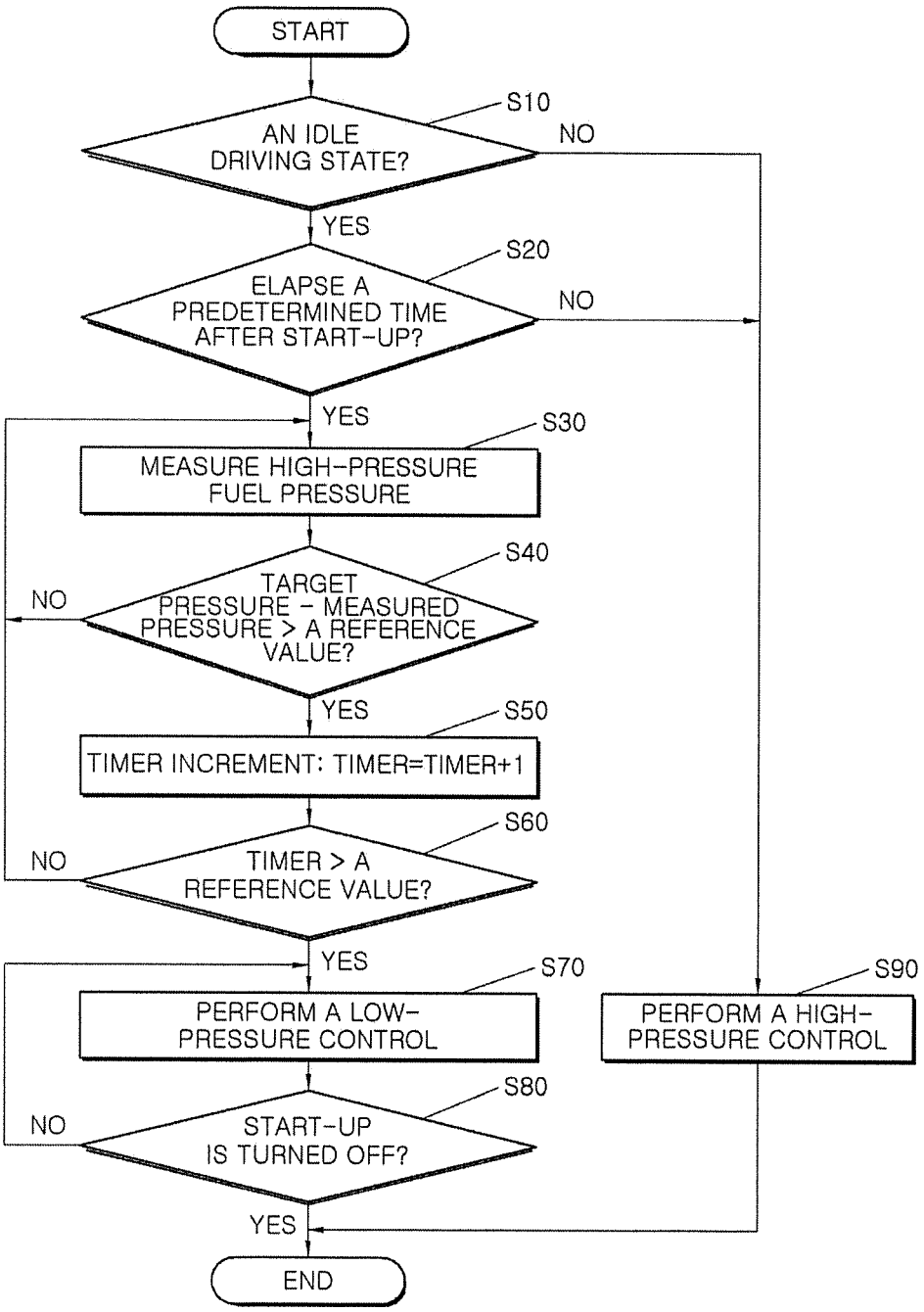
FIG. 3 is a flowchart illustrating a method of preventing engine stall in accordance with a preferred embodiment of the present disclosure.
Figure 5A:
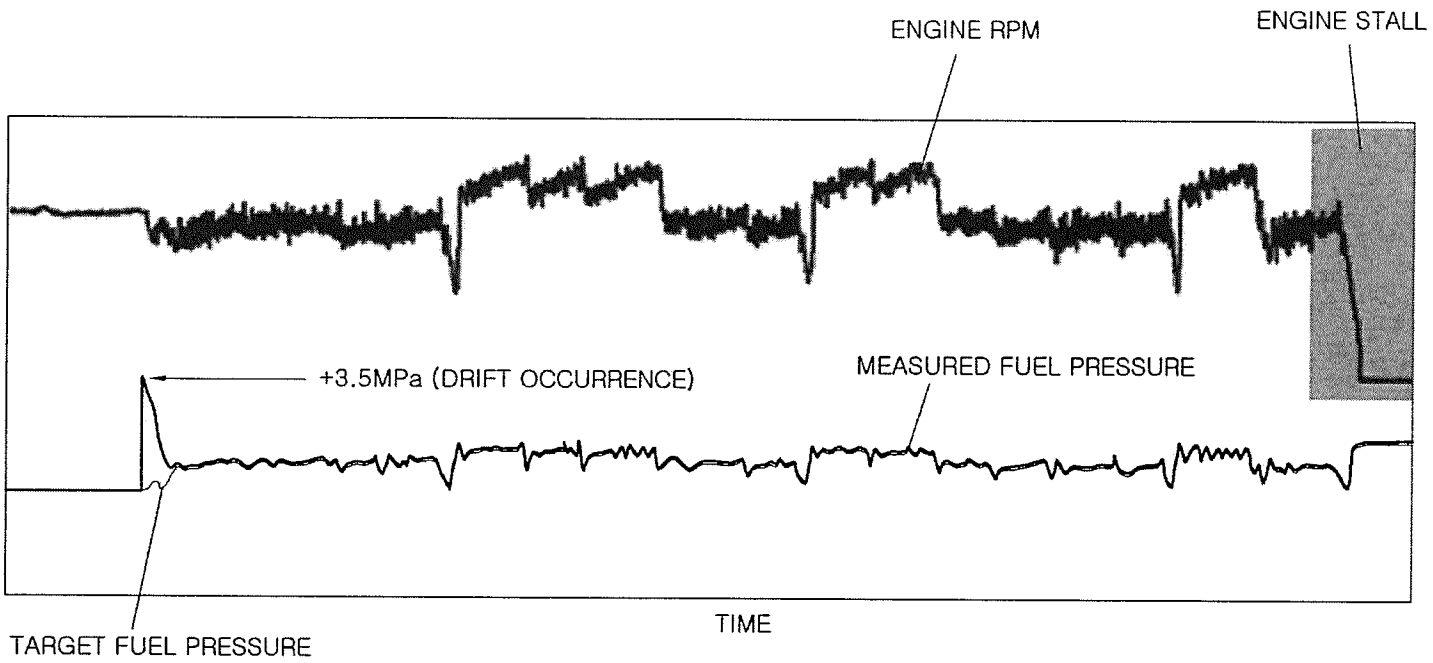
FIG. 5A is a graph illustrating drift occurrence in a pressure sensor output signal and the change in the RPM of an engine at that time in a fuel pressure control in accordance with the conventional control method.
Figure 5B:
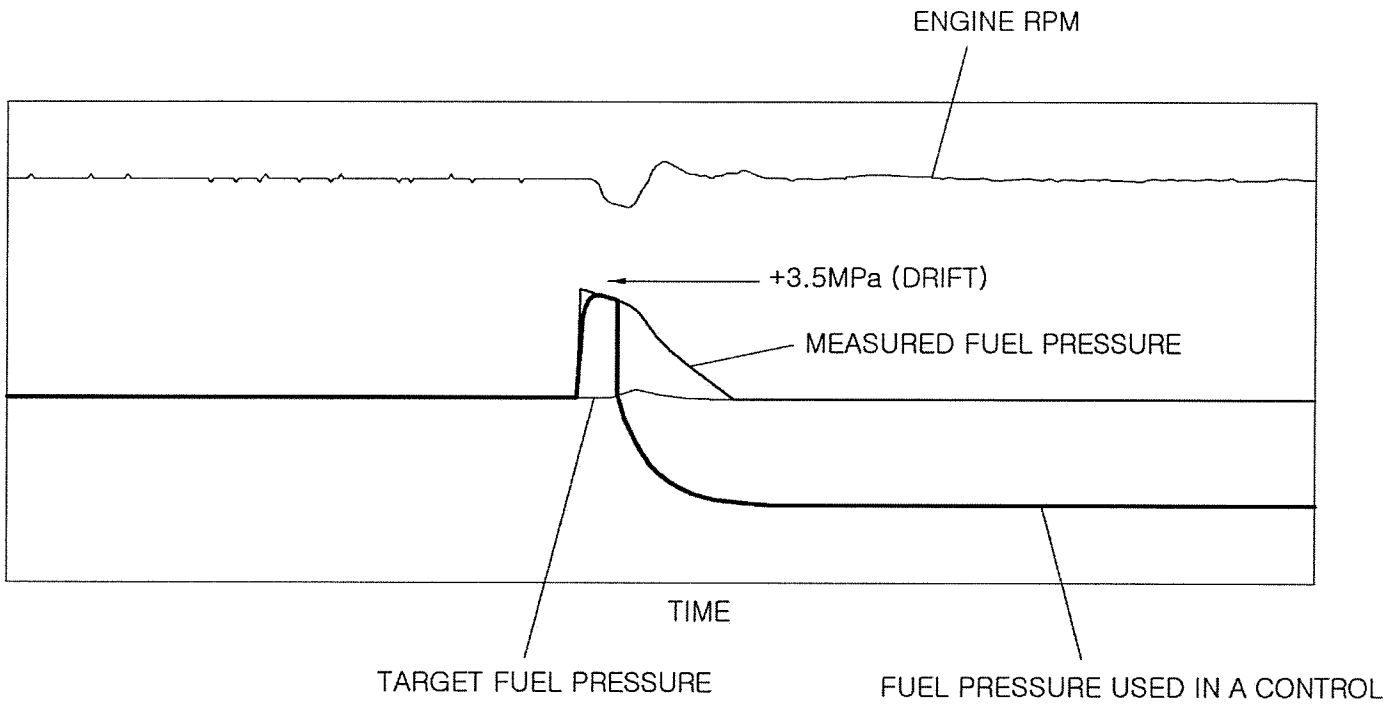
FIG. 5B is a graph illustrating drift occurrence in a pressure sensor output signal and the change in the RPM of an engine at that time when applying the method of preventing engine stall in accordance with the present disclosure.

The high-pressure fuel pressure sensor 61 is, preferably, as illustrated in FIG. 3, installed inside the common rail 60 to measure the pressure of the fuel stored in the common rail 60 to measure the high-pressure fuel pressure at the downstream of the high-pressure fuel pump 50. However, as illustrated in FIGS. 5A and 5B, there can occur the phenomenon that the output level of the high-pressure fuel pressure sensor 61 rapidly increases or decreases due to time, temperature, or any cause regardless of the actual fuel pressure value.

When the fuel pressure control is continuously performed using the output value of the high-pressure fuel pressure sensor 61 even though a drift has occurred in the output signal of the high-pressure fuel pressure sensor 61, there occurs a problem in that the fuel injection amount based on the measured fuel pressure becomes excessive (rich) or overly small (lean) compared to the preferred fuel injection amount depending upon the required output. As a result, the RPM of the engine becomes unstable, causing the engine stall problem. Particularly, in the idle driving section in which the RPM of the engine is low, the possibility that the engine stall occurs upon the drift occurrence in the fuel pressure sensor signal rapidly becomes high.

Accordingly, in order to solve the above problem, according to an aspect of the present disclosure, the engine control unit 10 performs the pressure control by not using the output value of the high-pressure fuel pressure sensor 61 when a drift occurs in the fuel pressure sensor signal.

For this purpose, the engine control unit 10 first determines whether or not a drift has occurred. Herein, whether or not the drift has occurred can be determined by comparing the measured fuel pressure with the target pressure value. For example, when the difference between the target fuel pressure value and the high-pressure fuel pressure value measured by the high-pressure fuel pressure sensor 61 exceeds a predetermined reference value, it can be reasonably suspected that a drift has occurred. However, the rapid change of the measured pressure value cannot be caused by the drift phenomenon of the pressure sensor but can be a temporary phenomenon due to instantaneous physical abnormality or noise of the fuel supply system, or other causes. Accordingly, in the preferred embodiment of the present disclosure, in order to more clarify whether or not a drift in a signal has occurred, the timer is increased when the difference between the target pressure value and the measured fuel pressure exceeds the reference value. Then, when the timer exceeds a predetermined value, that is, the phenomenon that the difference between the target pressure value and the measured fuel pressure exceeds the reference value is repeated by a predetermined reference value or more, it is determined that the drift has occurred.

Meanwhile, when it is determined that the drift has occurred in the output signal of the high-pressure fuel pressure sensor 61, the preferred embodiment of the present disclosure performs a low-press control that does not perform the pressure control based on the high-pressure pressure at the downstream side of the high-pressure fuel pump 50, and performs only the pressure control based on the low-pressure pressure at the upstream side of the high-pressure fuel pump 50. That is, it performs a control so that the measured value measured from the low-pressure fuel pressure sensor 40 follows the target low pressure. The low-pressure control is performed by feedback-controlling the motor actuator 31 of the low-pressure fuel pump 30 or adjusting the opening of a low-pressure fuel valve (not illustrated) installed in a fuel supply pipe between the low-pressure fuel pump 30 and the high-pressure fuel pump 50. The RPM of the engine is relatively low as 500~600 rpm, and the change amount of the fuel injection amount or the fuel pressure is not large during the idle driving of a vehicle, while as described above, there is the characteristic that is vulnerable to a engine stall problem. Accordingly, it is necessary to perform a control to further weigh on preventing engine stall rather than a precise fuel pressure control during an idling driving. Accordingly, the present disclosure does not perform the high-pressure control based on the high pressure at the downstream side of the high-pressure fuel pump 50, and performs the low-pressure control based on the low pressure at the upstream side of the high-pressure fuel pump 50, thus preventing engine stall.

Through the above-described low-pressure control, it is possible to somewhat suppress the engine stall due to the output signal drift of the pressure sensor. However, the procedure that stably switches from the high-pressure control to the low-pressure control needs a certain time, and the possibility of occurrence of the engine stall due to erroneous pressure value during that time cannot be completely excluded. Accordingly, in order to more reliably suppress the engine stall due to the signal drift, a more immediate response method is required.

For this purpose, when it is determined that the drift has occurred in the output signal of the high-pressure fuel pressure sensor 61, another preferred embodiment of the present disclosure does not use the output value of the high-pressure fuel pressure sensor 61, and uses the pressure value determined by a predetermined map, as the high-pressure pressure at the downstream side of the high-pressure fuel pump 50. For this purpose, the engine control unit 10 stores, as a map, a table of the high-pressure fuel pressure value depending upon the driving state of the vehicle, particularly, the idle driving state. For example, the high-pressure fuel pressure value corresponding to the state variable of the engine such as the idle RPM of the engine or the rotational torque is stored in the engine control unit 10 in the form of a table, and the engine control unit 10 selects an appropriate high-pressure fuel pressure value depending upon the driving state of the vehicle based on the table, and replaces the measured fuel pressure value with the selected high-pressure fuel pressure value. Then, assuming the replaced high-pressure fuel pressure value as an actual high-pressure fuel pressure value, the pressure control is performed so that the pressure at the downstream side of the high-pressure fuel pump 50 becomes the target pressure value. As illustrated in FIG. 5B, even when the pressure value measured by the high-pressure fuel pressure sensor 61 exceeds the target pressure value by 3.5 MPa or more, it can be seen that it is possible to replace the measured pressure value with the pre-stored pressure value, thus stably maintaining the RPM of the engine. As a result, the engine stall problem due to the drift occurrence can be solved.

However, the pressure value pre-stored in the engine control unit 10 is not an actual high-pressure fuel pressure value but only an estimated value depending upon the driving state. Accordingly, it is difficult to continue the fuel pressure control or the fuel injection amount control using the replaced pressure value.

According to another preferred embodiment in accordance with the present disclosure, the measured pressure value is replaced with the pre-stored pressure value, and then switches into the low-pressure control. It is possible to replace the measured pressure value with the pre-stored pressure value to first provide a preemptive and immediate response, and then to switch into the low-pressure control, thus surely preventing the possibility of engine stall and in addition, somewhat implementing stable fuel pressure control and fuel amount injection control. Preferably, it performs the high-pressure control by replacing the measured pressure value with the pre-stored pressure value, and then can switch it into the low-pressure control immediately after a predetermined time elapses.

After switching into the low-pressure control, the engine control unit 10 maintains the low-pressure control state during the corresponding driving cycle as it is until the ignition key is turned off by the driver. Then, after the re-start is made by the driver, it is determined whether or not the drift has occurred, and when it is determined that the drift has not occurred, the low-pressure control is canceled and the normal high-pressure control is performed again.

FIG. 3 is a flowchart illustrating a method for preventing engine stall in accordance with a preferred embodiment of the present disclosure. The control method illustrated in FIG. 3 is the embodiment relating to a control method for preventing engine stall by performing a low-pressure control when a signal drift has occurred.

As illustrated in FIG. 3, the engine control unit 10 first determines whether or not the vehicle is now in an idle driving state S10. As described above, in the idle driving state, the RPM of the engine is relatively low as about 500~600 rpm, and there is an extremely high possibility that the engine stall problem due to the signal drift occurs. On the other hand, when switching the existing high-pressure control into the low-pressure control for the engine stall prevention control, it is difficult to accurately perform the fuel pressure control and the fuel injection amount control in order to achieve the required torque. Accordingly, the engine stall prevention control is performed only in the idle driving state, and whether or not it is in the idle driving state is first determined in order to maintain the high-pressure control in the remaining driving state as it is S90.

When it is determined to be in the idle driving state, the engine control unit 10 determines whether or not a certain time has elapsed after the start-up S20. Since the fuel pressure is not stabilized until the certain time elapses after the start-up, it is difficult to determine whether or not the signal drift has occurred based on the difference between the fuel pressure and the target pressure. Accordingly, by first determining whether or not the certain time has elapsed after the start-up to determine whether or not the signal drift has occurred only after the certain time has elapsed, a control depending upon the above is performed, and the high-pressure control is maintained as it is within the certain time after the start-up S90.

When it is determined that the driving state of the vehicle is in the idle state and the certain time has elapsed after the start-up, the engine control unit 10 measures the fuel pressure of the high-pressure fuel at the downstream side of the high-pressure fuel pump 50 using the high-pressure fuel pressure sensor 61 in order to determine whether or not the signal drift has occurred S30. When the drift occurs in the pressure signal, the signal level of the high-pressure fuel pressure sensor 61 changes instantaneously, rapidly. Accordingly, there occurs the case that the pressure value of the measured high-pressure fuel exceeds the target fuel pressure value for achieving the required torque. Accordingly, in order to determine whether or not the drift has occurred, the engine control unit 10 first determines whether or not the difference in the high-pressure fuel pressure value measured by the high-pressure fuel pressure sensor 61 has exceeded a predetermined reference value S40.

When the measured pressure value exceeds the target pressure value by the reference value or more, it can be reasonably suspected that the drift has occurred. However, in order to confirm whether or not the signal drift has occurred, it is necessary to determine whether or not the phenomenon that the measured pressure value repeatedly exceeds the target pressure value by the reference value or more appears repeatedly. For this purpose, the engine control unit 10 increases the timer by 1 when the measured pressure value exceeds the target pressure value by the reference value or more S50. When the timer as the increased result exceeds the predetermined reference value, that is, when the phenomenon that the difference between the target pressure value and the measured fuel pressure exceeds the reference value is repeated by the predetermined reference value or more, it is determined that the drift has occurred S60. The timer is reset to zero when the ignition key is turned off by the driver, and is added again in next driving cycle.

As a measurement result by the high-pressure fuel pressure sensor 61, when it is determined that the drift has occurred in the pressure sensor signal, the low-pressure control is performed that does not perform the pressure control based on the high-pressure pressure at the downstream side of the high-pressure fuel pump 50, and performs only the pressure control based on the low-pressure pressure at the upstream side of the high-pressure fuel pump 50 S70. That is, a control is performed so that the measured value measured from the low-pressure fuel pressure sensor 40 follows the target low pressure. As a result, it is possible to block the influence by the signal drift of the high-pressure fuel pressure sensor 61, thus preventing engine stall.

The low-pressure control in the S70 is continued until the ignition key is turned off by the driver S80. Then, when the driver performs the re-start, it is determined again whether or not the drift has occurred, and when it is determined that the drift has not occurred, the low-pressure control is canceled and the normal high-pressure control is performed again.

Figure 4A:
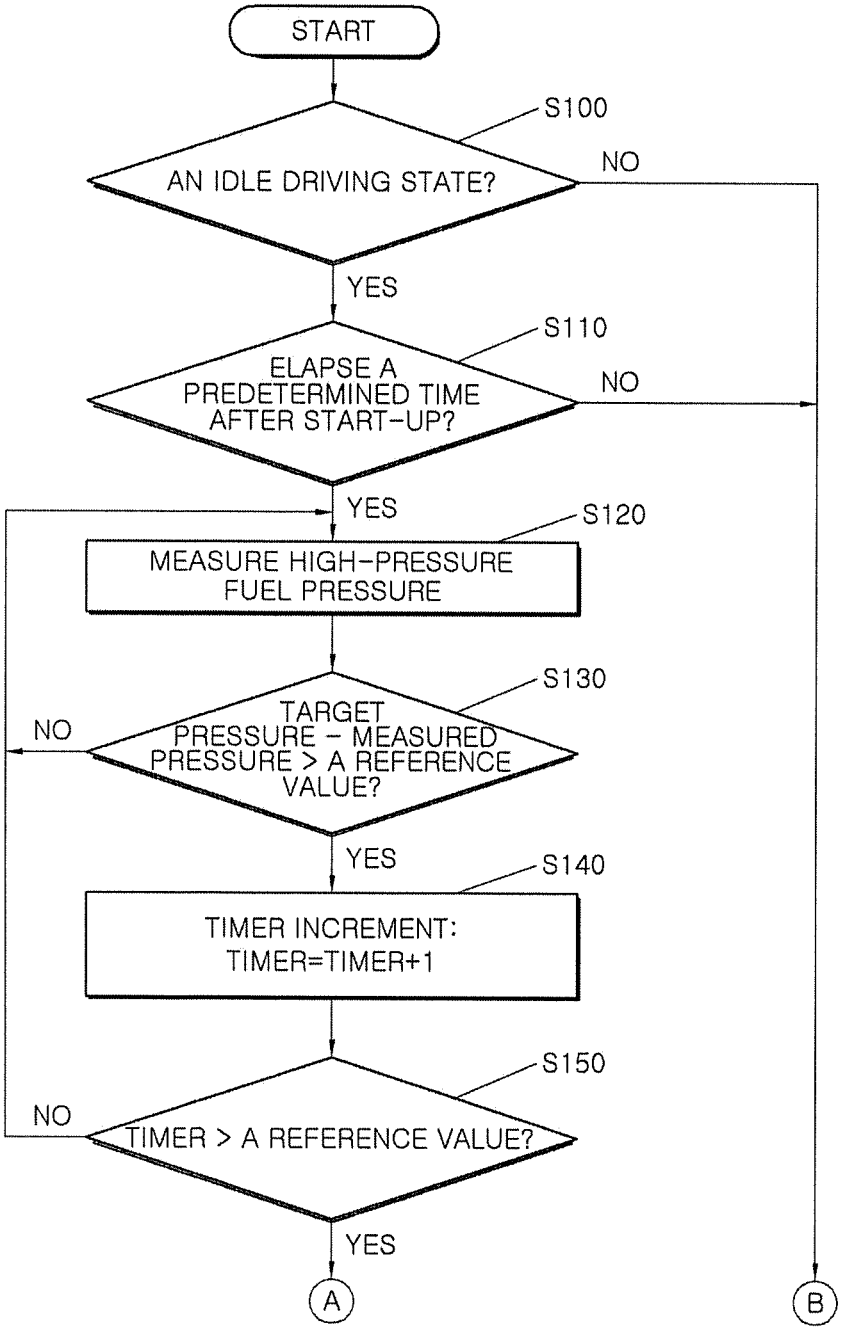
FIGS. 4A and 4B are flowcharts illustrating a method of preventing engine stall in accordance with another preferred embodiment of the present disclosure.
Figure 4B:
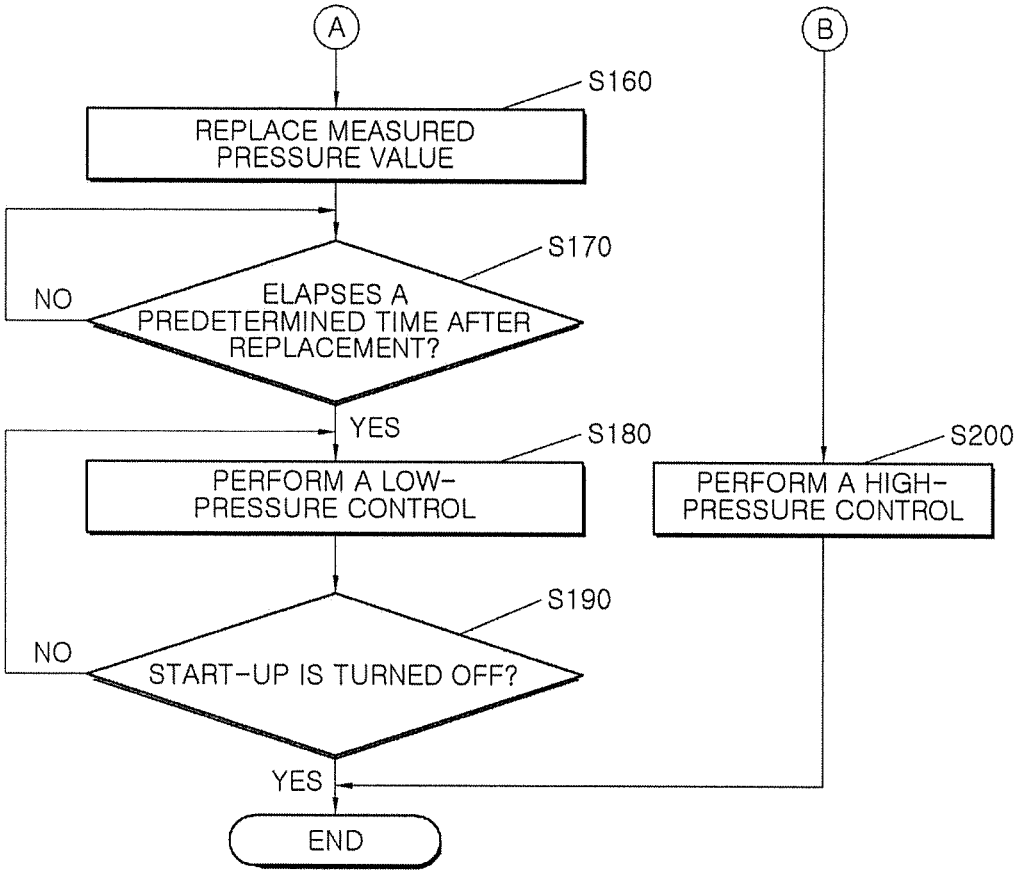

FIGS. 4A and 4B are flowcharts illustrating a method of preventing engine stall in accordance with another preferred embodiment of the present disclosure. Unlike the control method illustrated in FIG. 3, the control method illustrated in FIGS. 4A and 4B do not perform the low-pressure control when the signal drift has occurred, and performs the high-pressure control by replacing a high-pressure fuel pressure value with a predetermined pressure value, thus preventing the engine stall. A detailed description of the steps substantially the same as those illustrated in FIG. 3 will be omitted.

As illustrated in FIGS. 4A and 4B, in S150, when it is determined that a drift has occurred in the pressure sensor signal, the engine control unit 10 does not use the output value of the high-pressure fuel pressure sensor 61 and uses the pressure value determined by a predetermined map as the high-pressure pressure at the downstream side of the high-pressure fuel pump 50. For example, an appropriate high-pressure fuel pressure value depending upon the current driving state of the vehicle is selected from a table composed of the high-pressure fuel pressure value corresponding to the state variable of the engine such as the idle RPM of the engine or the rotational torque, and the measured fuel pressure value is replaced with the high-pressure fuel pressure value. Then, assuming the replaced high-pressure fuel pressure value as the actual high-pressure fuel pressure value, the high-pressure control is performed so that the high-pressure fuel pressure at the downstream side of the high-pressure fuel pump 50 becomes the target pressure value S160. As a result, like the low-pressure control illustrated in FIG. 3, it is possible to block the influence by the signal drift of the high-pressure fuel pressure sensor 61, thus preventing engine stall.

Preferably, the engine control unit 10 determines whether or not a predetermined time has elapsed after the replacement of the pressure value of the high-pressure fuel is performed S170. When it is determined that the drift has occurred in the pressure sensor signal, the possibility that the engine stall immediately occurs becomes remarkably high, such that it is first necessary to immediately replace the pressure value of the high-pressure fuel with the stable target value. However, since the replaced pressure value is not the actual fuel pressure value, accurate fuel pressure control or fuel injection control for achieving the required torque is difficult. Accordingly, when it is determined that the predetermined time has elapsed, the control is switched from the high-pressure control for controlling the pressure based on the pressure at the downstream side of the high-pressure fuel pump 50 into the low-pressure control illustrated in FIG. 3 S180.

FIG. 5A illustrates the change in the RPM of the engine when a drift occurs in the high-pressure pressure sensor signal when applying the conventional control method. According to the contents illustrated in FIG. 5A, the pressure value of the high-pressure fuel measured at a specific timing exceeds 3.5 MPa compared to the target pressure value. As a result, it can be seen that a drift occurs in the pressure sensor signal at that timing. Meanwhile, according to the contents illustrated in FIG. 5A, it can be seen that the RPM of the engine rapidly becomes unstable immediately after the drift occurrence. That is, as a result of the rapid change of the fuel pressure value of the high-pressure fuel, the amount of the fuel supplied to the engine based on the pressure value of the high-pressure fuel also changes and thereby, the driving of the engine becomes unstable. As a result, engine stall has occurred.

FIG. 5B illustrates the change in the RPM of the engine when a drift occurs in the high-pressure pressure sensor signal when applying the method for preventing engine stall in accordance with the present disclosure. As in the case illustrated in FIG. 5A, it can be seen that the pressure value of the high-pressure fuel measured at a specific timing exceeds 3.5 MPa compared to the target pressure value, such that a drift occurs in the signal. However, unlike the result of FIG. 5A that uses the high-pressure pressure sensor signal where the drift has occurred as it is, the embodiment illustrated in FIG. 5B has replaced the measured high-pressure fuel pressure value with a predetermined pressure value. As a result, it can be seen that the high-pressure fuel pressure value in which the pressure control is based is kept constant to stably maintain the RPM of the engine, thus not causing the engine stall problem.

What is claimed is:

1. A method of preventing an engine stall of a vehicle having a fuel injection device for pressurizing fuel stored in a fuel tank by a high-pressure fuel pump to transmit the fuel to a common rail, and injecting the fuel temporarily stored in the common rail into an engine through an injector, comprising steps of:

determining whether or not a drift occurs in an output signal of a high-pressure fuel pressure sensor for measuring fuel pressure at a downstream side of the high-pressure fuel pump; and performing a fuel pressure control by replacing a high-pressure fuel pressure value with a predetermined pressure value based on the output signal of the high-pressure fuel pressure sensor, wherein the step of determining whether or not the drift occurs in the output signal of the high-pressure fuel pressure sensor comprises:

determining whether or not a pressure difference between a target fuel pressure and an actual fuel pressure measured from the high-pressure fuel pressure sensor is equal to or greater than a certain value;

increasing a counter when the pressure difference is equal to or greater than the certain value; and determining that the drift has occurred in the output signal of the high-pressure fuel pressure sensor when the counter is equal to or greater than a certain value.

2. The method of preventing the engine stall of the vehicle of claim 1, wherein, after the step of performing the fuel pressure control by replacing the high-pressure fuel pressure value based on the output signal of the high-pressure fuel pressure sensor with the predetermined pressure value, the fuel pressure control is performed through a low-pressure control based on low-pressure fuel pressure at an upstream side of the high-pressure fuel pump.

3. The method of preventing the engine stall of the vehicle of claim 1, further comprising determining whether or not the vehicle is now in an idle driving state, wherein, when it is determined that the vehicle is now in the idle driving state, the fuel pressure control is performed.

4. The method of preventing the engine stall of the vehicle of claim 3, wherein the predetermined pressure value is determined from a predetermined map relating to the fuel pressure value depending upon a driving state of the vehicle.

5. The method of preventing the engine stall of the vehicle of claim 1, further comprising:

determining whether or not a predetermined time has elapsed after a start-up, and performing the fuel pressure control when it is determined that the predetermined time has elapsed after the start-up.

6. A method of preventing an engine stall of a vehicle having a fuel injection device for pressurizing fuel stored in a fuel tank by a high-pressure fuel pump to transmit the fuel to a common rail, and injecting the fuel temporarily stored in the common rail into an engine through an injector, comprising steps of:

when it is determined that a drift has occurred in an output signal of a high-pressure fuel pressure sensor for measuring fuel pressure at a downstream side of the high-pressure fuel pump, performing a fuel pressure control through a low-pressure control based on low-pressure fuel pressure at an upstream side of the high-pressure fuel pump without using the output signal of the high-pressure fuel pressure sensor.

7. The method of preventing the engine stall of the vehicle of claim 6, further comprising determining whether or not the vehicle is now in an idle driving state, wherein, when it is determined that the vehicle is now in the idle driving state, the fuel pressure control is performed.

8. The method of preventing engine stall of the vehicle of claim 7, wherein the predetermined pressure value is determined from a predetermined map relating to the fuel pressure value depending upon a driving state of the vehicle.

9. The method of preventing engine stall of the vehicle of claim 6, wherein the step of determining whether or not the drift occurs in the output signal of the high-pressure fuel pressure sensor comprises:

determining whether or not a pressure difference between a target fuel pressure and an actual fuel pressure measured from the high-pressure fuel pressure sensor is equal to or greater than a certain value;

increasing a counter when the pressure difference is equal to or greater than the certain value; and determining that the drift has occurred in the output signal of the high-pressure fuel pressure sensor when the counter is equal to or greater than a certain value.

10. The method of preventing the engine stall of the vehicle of claim 6, further comprising determining whether or not a predetermined time has elapsed after a start-up, and performing the fuel pressure control when it is determined that the predetermined time has elapsed after the start-up.

11. An apparatus for preventing an engine stall of a vehicle, comprising:

a fuel injection device for pressurizing fuel stored in a fuel tank by a high-pressure fuel pump to transmit the fuel to a common rail, and injecting the fuel temporarily stored in the common rail into an engine through an injector;

a high-pressure fuel pressure sensor for measuring high-pressure fuel pressure at a downstream side of the high-pressure fuel pump; and an engine control unit for determining whether or not a drift occurs in an output signal of the high-pressure fuel pressure sensor, and upon occurrence of the drift, performing a fuel pressure control by replacing a high-pressure fuel pressure value with a predetermined pressure value based on the output signal of the high-pressure fuel pressure sensor, wherein the engine control unit determines whether or not the drift occurs in the output signal of the high-pressure fuel pressure sensor by determining whether or not a pressure difference between a target fuel pressure and an actual fuel pressure measured from the high-pressure fuel pressure sensor is equal to or greater than a certain value, increasing a counter when the pressure difference is equal to or greater than the certain value, and determining that the drift has occurred in the output signal of the high-pressure fuel pressure sensor when the counter is equal to or greater than a certain value.

12. The apparatus for preventing the engine stall of the vehicle of claim 11, wherein the engine control unit performs the fuel pressure control by replacing the high-pressure fuel pressure value with the predetermined pressure value based on the output signal of the high-pressure fuel pressure sensor, and then performs the fuel pressure control through a low-pressure control based on low-pressure fuel pressure at an upstream side of the high-pressure fuel pump.

13. The apparatus for preventing the engine stall of the vehicle of claim 11, wherein the engine control unit performs the fuel pressure control when the vehicle is in an idle driving state.

14. The apparatus for preventing the engine stall of the vehicle of claim 11, wherein the engine control unit comprises a predetermined map relating to a fuel pressure value depending upon a driving state of the vehicle, and the predetermined pressure value is determined using the predetermined map.

15. An apparatus for preventing an engine stall of a vehicle, comprising:

a fuel injection device for pressurizing fuel stored in a fuel tank by a high-pressure fuel pump to transmit the fuel to a common rail, and injecting the fuel temporarily stored in the common rail into an engine through an injector;

a high-pressure fuel pressure sensor for measuring high-pressure fuel pressure at a downstream side of the high-pressure fuel pump; and an engine control unit for determining whether or not a drift occurs in an output signal of the high-pressure fuel pressure sensor, and upon occurrence of the drift, performing a fuel pressure control through a low-pressure control based on low-pressure fuel pressure at an upstream side of the high-pressure fuel pump without using the output signal of the high-pressure fuel pressure sensor.

16. The apparatus for preventing the engine stall of the vehicle of claim 15, wherein the engine control unit performs the fuel pressure control when the vehicle is in an idle driving state.

* * * * *